US012193619B1

(12) United States Patent
Lane

(10) Patent No.: US 12,193,619 B1
(45) Date of Patent: Jan. 14, 2025

(54) DISPOSABLE PERSONAL CARE APPARATUS

(71) Applicant: Helmm, New York, NY (US)

(72) Inventor: Taylor Lane, New York, NY (US)

(73) Assignee: Helmm, New York, NY (US)

( * ) Notice: Subject to any disclaimer, the term of this patent is extended or adjusted under 35 U.S.C. 154(b) by 0 days.

(21) Appl. No.: 18/494,289

(22) Filed: Oct. 25, 2023

(51) Int. Cl.
*A47K 7/02* (2006.01)
*A47K 7/03* (2006.01)
*A47K 7/04* (2006.01)

(52) U.S. Cl.
CPC ..... *A47K 7/028* (2013.01); *A47K 7/03* (2013.01); *A47K 7/043* (2013.01)

(58) Field of Classification Search
CPC ..... A47K 7/028; A47K 7/03; A47K 7/043
See application file for complete search history.

(56) References Cited

U.S. PATENT DOCUMENTS 178,883 A 6/1876 Stockhouse
562,033 A 6/1896 Rounds
680,052 A 8/1901 Lynch
702,531 A 6/1902 Bowen
727,368 A 5/1903 Howard
817,985 A 4/1906 Pinches
846,936 A 3/1907 Nishimoto
852,305 A 4/1907 Wach
1,027,208 A 5/1912 Manheim
1,073,921 A 9/1913 Morgan
1,092,436 A 4/1914 Dye
1,221,939 A 4/1917 Wirth
1,326,265 A 12/1919 Hobbs
1,332,096 A 2/1920 Applegate
1,333,941 A 3/1920 Herman
1,337,535 A 4/1920 Wolfe
1,350,585 A 8/1920 Wirth
1,406,699 A 2/1922 Stewart
1,437,217 A 11/1922 Marcel
1,554,837 A 9/1925 Martin
1,577,861 A 3/1926 Henry
1,590,118 A 6/1926 Parker
1,617,466 A 2/1927 Ole
1,660,351 A 2/1928 Alexaner
1,667,045 A 4/1928 Blanchard
1,675,022 A 6/1928 Creegan
1,689,787 A 10/1928 Kupferschmid
1,745,798 A 2/1930 Otto
1,748,008 A 2/1930 Barnowitz
(Continued)

*Primary Examiner* — Jennifer C Chiang
(74) *Attorney, Agent, or Firm* — Carter, DeLuca & Farrell LLP

(57) ABSTRACT

A disposable personal care apparatus includes a main body and a handle. The main body has a first body end and a second body end. The main body includes soap. The handle is configured to be grasped for moving the main body. The handle is integrally formed with the main body. The handle has a first handle end and a second handle end. The second handle end of the handle is closer to the first body end of the main body than the second body end of the main body. The main body is configured to support the handle in an upright position over the main body when the second body end of the main body is positioned on a surface. A longitudinal axis extends a length of the disposable personal care apparatus from the first handle end to the second body end.

19 Claims, 15 Drawing Sheets

(56) References Cited

U.S. PATENT DOCUMENTS 1,757,590 A 5/1930 Rconey
1,787,660 A 1/1931 Blakeley
1,863,778 A 6/1932 Welsh
1,927,462 A 9/1933 Marsh-Hunn
1,950,318 A 3/1934 McNab
2,194,997 A 3/1940 Butler
2,243,634 A 5/1941 Kadish
2,283,988 A 5/1942 Heath
2,409,827 A 10/1946 Blankner
2,468,192 A 4/1949 Gennusa
2,490,657 A 12/1949 Shuman
2,568,714 A 9/1951 Lester
2,577,114 A 12/1951 Eames
2,586,626 A 2/1952 Dunn
2,717,472 A 9/1955 Wilmington
2,770,071 A 11/1956 Endres et al.
2,883,791 A 4/1959 Carlo
2,891,348 A 6/1959 Blagg
2,934,852 A 5/1960 Heberling
2,946,074 A 7/1960 Caldwell
2,963,724 A 12/1960 Peveril
3,019,548 A 2/1962 Nadler
3,055,040 A 9/1962 Schermerhorn
3,058,139 A 10/1962 Dryden
3,071,886 A 1/1963 Stiller
3,094,806 A 6/1963 Herrero
3,100,363 A 8/1963 Staver
3,124,827 A 3/1964 Hull
3,125,824 A 3/1964 Staver
3,142,414 A 7/1964 Mandich
3,160,523 A 12/1964 Hull
3,192,894 A 7/1965 Staver
3,203,024 A 8/1965 Hawkins et al.
3,204,601 A 9/1965 Staver
3,206,152 A 9/1965 Wimmer
3,251,571 A 5/1966 Ernest
3,262,421 A 7/1966 Staver
3,286,686 A 11/1966 Staver
3,288,104 A 11/1966 Staver
3,288,105 A 11/1966 Staver
3,315,933 A 4/1967 Tatham
3,325,133 A 6/1967 Bertges
3,338,540 A 8/1967 Barish
3,362,776 A 1/1968 Knorr
3,426,464 A 2/1969 Mezey
3,453,705 A 7/1969 Kamen
3,519,568 A 7/1970 Needleman
3,542,411 A 11/1970 Filas
3,608,853 A 9/1971 Sertich
3,671,438 A 6/1972 Cilia
3,697,111 A 10/1972 Thompson
3,932,909 A 1/1976 Johnson et al.
4,136,902 A 1/1979 Leonard
4,196,490 A 4/1980 Jonzon
4,203,857 A 5/1980 Dugan
4,211,445 A 7/1980 Woods
4,309,014 A 1/1982 Blaszkowski
4,311,604 A 1/1982 Hornig
4,371,140 A 2/1983 von Obstfelder
4,688,751 A 8/1987 Valot
4,728,210 A * 3/1988 Barish ..... A45D 40/00 401/98
4,775,256 A 10/1988 Roth
4,861,505 A 8/1989 Farman
4,879,063 A 11/1989 Wood-Rethwill et al.
5,011,316 A 4/1991 Damon
5,029,802 A 7/1991 Ali
5,058,234 A 10/1991 Humenay
5,087,188 A 2/1992 Staver
5,207,725 A 5/1993 Pinkerton
5,390,971 A 2/1995 Warren
5,486,064 A 1/1996 Schulte
5,890,824 A 4/1999 Loch
6,036,393 A 3/2000 Youtcheff et al.
6,190,079 B1 2/2001 Ruff
6,397,438 B1 6/2002 DeWan
6,438,787 B1 8/2002 Young
6,659,669 B1 12/2003 Nguyen
6,689,728 B2 2/2004 Diez
6,783,294 B2 8/2004 Duden et al.
6,799,917 B1 10/2004 Sampson
6,840,693 B1 1/2005 Bell
6,857,616 B1 2/2005 Gasperi et al.
6,929,232 B1 8/2005 Gasperi et al.
7,051,886 B1 5/2006 Han
7,323,438 B2 1/2008 Hedges et al.
7,459,418 B1 12/2008 Ozment
7,473,044 B2 1/2009 Collins
7,816,311 B2 10/2010 Feng et al.
7,838,480 B2 11/2010 Sidwa et al.
7,867,964 B2 1/2011 McFann et al.
8,141,565 B2 3/2012 Slavin
8,353,085 B2 1/2013 Balzano
8,926,205 B1 1/2015 Allen
8,967,898 B1 3/2015 Dayeh
9,009,908 B2 4/2015 Screen et al.
9,302,412 B2 4/2016 DiBelardino et al.
9,307,870 B2 4/2016 Gould
9,307,874 B2 4/2016 Smith
9,526,392 B2 12/2016 Konkey
9,572,966 B2 2/2017 Trudel et al.
9,603,492 B2 3/2017 Cannata
9,723,957 B2 8/2017 Firestone
9,756,990 B2 9/2017 Cassiday
9,918,593 B2 3/2018 LeBlanc et al.
10,071,399 B2 9/2018 Perlas et al.
10,112,758 B2 10/2018 Beyer
10,136,789 B2 11/2018 Zohar et al.
10,334,994 B1 7/2019 Burd
10,342,392 B2 7/2019 Bürgelin et al.
10,638,830 B2 5/2020 Robinson et al.
10,638,895 B2 5/2020 Knudsen
10,660,483 B2 5/2020 Hyde
10,736,472 B1 8/2020 Gardner
10,786,123 B1 9/2020 Chang
11,111,465 B1 9/2021 Gittlin
D970,250 S 11/2022 Tran
2006/0097122 A1 5/2006 Collins
2013/0096046 A1 4/2013 Liu
2013/0170890 A1 7/2013 Urban
2014/0299731 A1 10/2014 Kim et al.
2016/0309968 A1 10/2016 Kemp
2016/0338550 A1 11/2016 Cannata
2018/0020883 A1 1/2018 Healy
2018/0148674 A1 5/2018 Khamis et al.
2019/0029475 A1 1/2019 Hyde
2022/0133094 A1 5/2022 Claessens
2022/0225855 A1 7/2022 Satnaraine
2022/0296050 A1 9/2022 Tran
2022/0361719 A1 11/2022 Walker

* cited by examiner

DISPOSABLE PERSONAL CARE APPARATUS

TECHNICAL FIELD

This disclosure relates to personal care apparatus and, more particularly, to disposable personal care apparatus such as disposable cleansing apparatus for effectuating personal hygiene and skincare.

BACKGROUND

Disposable cleansing apparatus, such as soap bars, have long been utilized for maintaining personal cleanliness and hygiene. Disposable cleansing apparatus typically include soap or detergent ingredients molded into a solid form that is intended for single or limited use. Unfortunately, known disposable cleansing apparatus fail to adequately address specific user needs, particularly with respect to user experience. For example, design considerations of these disposable cleansing apparatus should address challenges associated with ease of handling under both dry and wet conditions, as well as product durability to help prolong shelf life and effectiveness of these disposable cleansing apparatus.

BRIEF DESCRIPTION OF THE DRAWINGS

The accompanying drawings, which are incorporated in and constitute a part of this specification, illustrate aspects of this disclosure and, together with a general description of this disclosure given above, and the detailed description given below, explain the principles of this disclosure, wherein.

DETAILED DESCRIPTION

Figure 1:
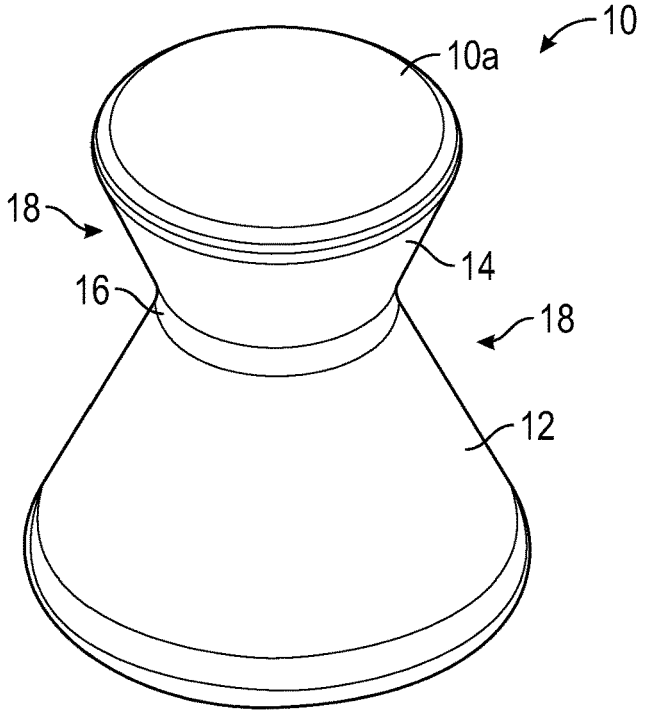
FIG. 1 is a perspective view of a disposable personal care apparatus in accordance with the principles of this disclosure.
Figure 2:
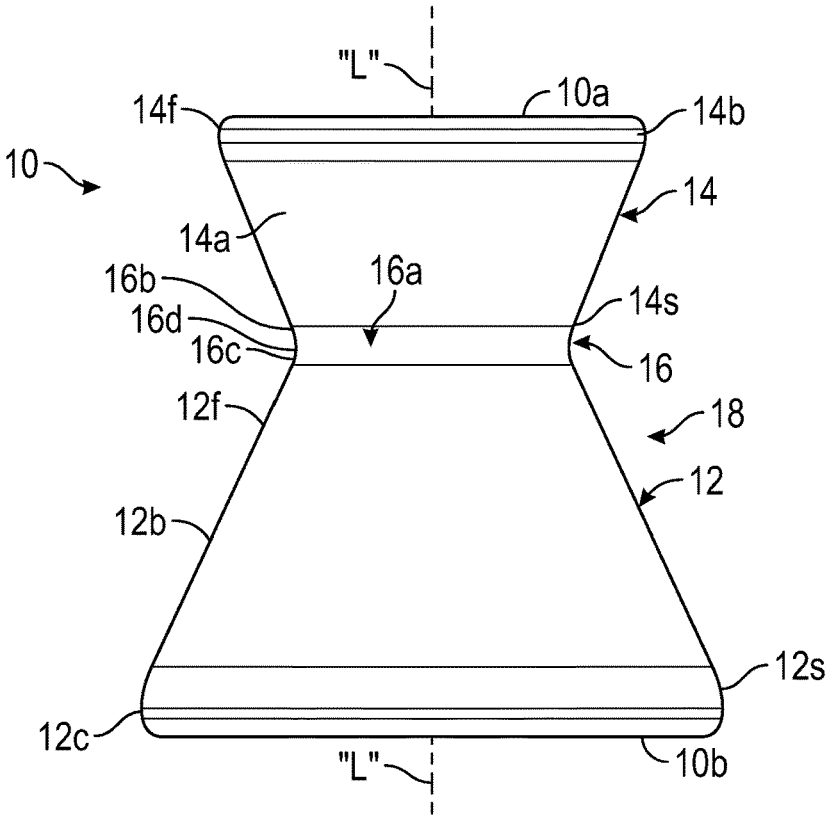
FIG. 2 is a side view of the disposable personal care apparatus of FIG. 1.
Figure 3:
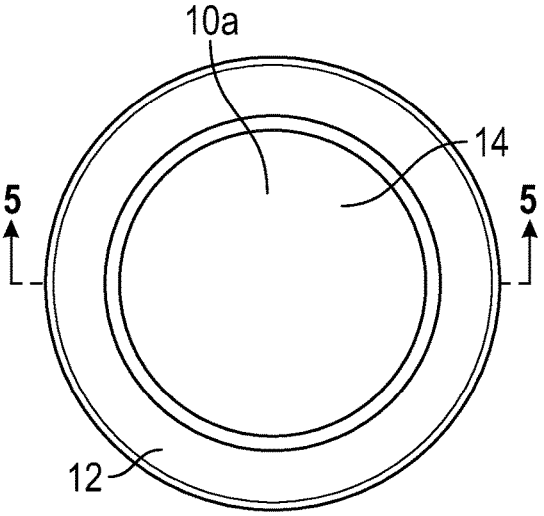
FIG. 3 is a top view of the disposable personal care apparatus of FIG. 1.
Figure 4:
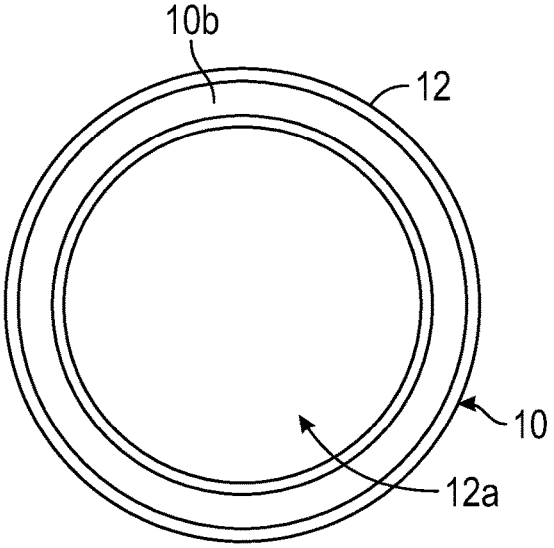
FIG. 4 is a bottom view of the disposable personal care apparatus of FIG. 1.
Figure 5:
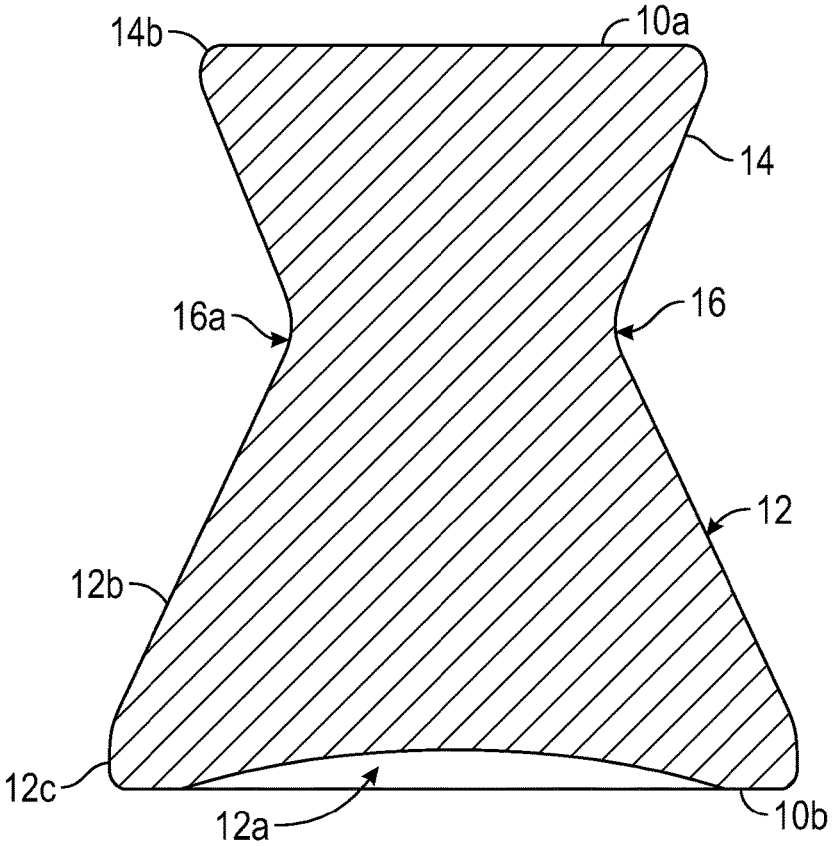
FIG. 5 is a cross-sectional view of the disposable personal care apparatus of FIG. 1 as taken along section line 5-5 shown in FIG. 3.

Aspects of this disclosure are described in detail with reference to the drawings, in which like reference numerals designate identical or corresponding elements in each of the several views. In the following description, well-known functions or constructions are not described in detail to avoid obscuring this disclosure in unnecessary detail. In addition, directional terms such as top, bottom, side, and similar terms are used to assist in understanding the description and are not intended to limit this disclosure.

With reference to FIGS. 1-5, a disposable personal care apparatus 10 has a unitary structure (e.g., integrally and/or monolithically formed) and may be in the form of a disposable cleansing apparatus including soap for cleaning the hands and/or the body of a user. The disposable personal care apparatus 10 may include a surfactant configured for cleaning skin. The disposable personal care apparatus 10 includes a top surface 10*a* and a bottom surface 10*b*.

The disposable personal care apparatus 10 defines a longitudinal axis "L" and includes a main body 12 and a handle 14 connected to the main body 12 by a stem 16.

In aspects, the main body 12 of the disposable personal care apparatus 10 defines a recess 12*a* that extends from the bottom surface 10*b* of the disposable personal care apparatus 10 and into the main body 12. In aspects, the main body 12 does not include a recess 12*a*. The main body 12 includes a first body end 12*f* and a second body end 12*s* disposed opposite to the first body end 12*f*. The main body 12 includes an annular sidewall 12*b* that tapers inwardly from the bottom surface 10*b* of the disposable personal care apparatus 10, which is a bottom surface of the main body 12, to a bottom end portion of the stem 16. The main body 12 includes a rounded annular edge 12*c* that connects the bottom surface 10*b* to the annular sidewall 12*b* of the main body 12.

The handle 14 of the disposable personal care apparatus 10 includes an annular sidewall 14*a* that tapers inwardly from the top surface 10*a* of the disposable personal care apparatus 10, which is a top surface of the handle 14, to a top end portion of the stem 16. The handle 14 has a first handle end 14*f* and a second handle end 14*s* that is disposed opposite to the first handle end 14*f* and closer to the first body end 12*f* of the main body 12 than the second body end 12*s* of the main body 12. The handle 14 includes a rounded annular edge 14*b* that connects the top surface 10*a* to the annular sidewall 14*a* of the handle 14.

The stem 16 of the disposable personal care apparatus 10, which may be part of the handle 14, defines an annular indentation 16*a*. The stem 16 further includes an upper portion 16*b*, a lower portion 16*c*, and an intermediate portion 16*d* that is disposed between the upper and lower portions 16*b*, 16*c*. In aspects, the intermediate portion 16*d* is narrower than the upper and/or lower portions 16*b*, 16*c*.

The annular sidewall 12*b* of the main body 12, the annular sidewall 14*a* of the handle 14, and the annular indentation 16*a* of the stem 16 define an annular cavity 18 about the disposable personal care apparatus 10.

In aspects, the main body 12 supports the handle 14 in an upright position over the main body 12 when the second body end 12*s* is mounted on a surface such as a counter, table, or shelf (not explicitly shown).

The handle 14 of the disposable personal care apparatus 10 is configured to increase hand or finger/digit (e.g., thumb and/or finger) grip and manipulation of the disposable personal care apparatus 10, particularly when the disposable personal care apparatus 10, or portions thereof, is/are wet and/or when the hand(s) of the user, digit(s) of the user, and/or portions thereof, are wet.

In use, the handle 14 of the disposable personal care apparatus 10 is grasped by the user so that the user can readily move the main body 12 (e.g., the bottom surface 10*b* of the main body 12) of the disposable personal care apparatus 10 along the user's skin so that the main body 12 of the disposable personal care apparatus 10, or portions thereof, can treat (e.g., cleanse and/or provide one or more therapeutic effects to the user's body, namely, the skin, for instance, by virtue of the one or more materials of the main body 12). As can be appreciated, the main body 12, or portions thereof, may rub off the main body 12 onto the user's skin or other object, for instance, by friction with the user's skin or other object. In aspects, such frictional engagement with the disposable personal care apparatus 10 can create a lather, e.g., a soapy lather, for cleaning, for example, the user's skin or other object. Of course, the disposable personal care apparatus 10 can also be rubbed and/or massaged onto a washcloth (not shown) or the like as desired for passing materials of the disposable personal care apparatus 10 onto the washcloth so that the washcloth can be used to cleanse the user's body or other object.

Although shown as having an hourglass configuration, the disposable personal care apparatus 10, or portions thereof, can have any suitable configuration. For instance, the main body 12, the handle 14, and/or the stem 16 may have conical, cylindrical, spherical ellipsoidal, pseudospherical, and/or like configurations. Indeed, in aspects, the disposable personal care apparatus 10, or portions thereof, may have polyhedral configurations such as cuboid, polygonal prism, polygonal pyramid, and/or the like.

Despite the complexities where the predictability of the outcome was low and prior solutions were unsuccessful or went in a different direction, the long and laborious process of conducting a multitude of trials, testing, and evaluations was conducted until the disclosed disposable personal care apparatus configured for increased comfort, gripability, and maneuverability by a user was unexpectedly developed. Notably, such trials, testing, and evaluations were based on, for example, standard protocols, or modified versions of such protocols, established by the American Society for Testing and Materials (e.g., ASTM 5054), and included evaluations of, for example, fracture initiation energy, fracture energy, and rate of wear (e.g., degradation rate). Indeed, through such effort, various metrics were considered for the following purposes:

a. improving user sizing of the disposable personal care apparatus for a user's hand and/or digits to promote gripability;
b. enabling the disposable personal care apparatus to stand upright on a surface;
c. preventing the handle of the disposable personal care apparatus from separating or snapping off the main body/stem of the disposable personal care apparatus;
d. ensuring that the main body degrades at the same rate or before the handle of the disclosed disposable personal care apparatus while maintaining the ability to stand upright on a surface; and
e. ensuring that the handle remains non-slip and/or easy-to-grip when the handle is dry or wet.

Figure 6:
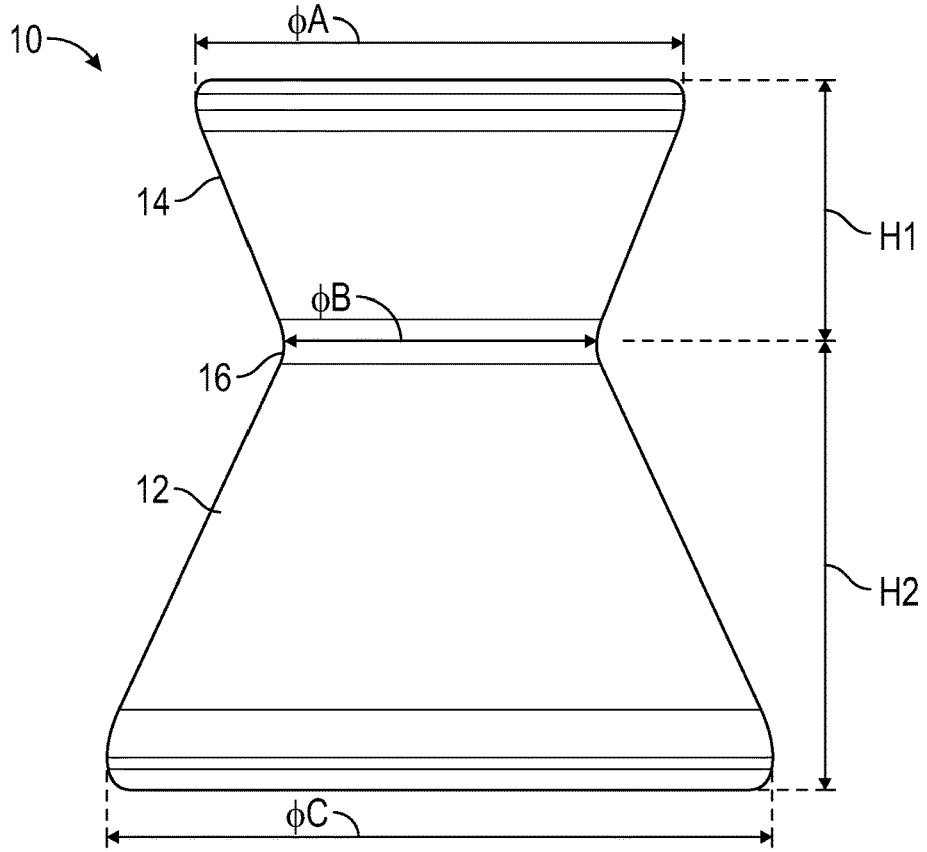
FIG. 6 is a view of FIG. 2 with different dimensions of the disposable personal care apparatus of FIG. 1 labeled.
Figure 6A:
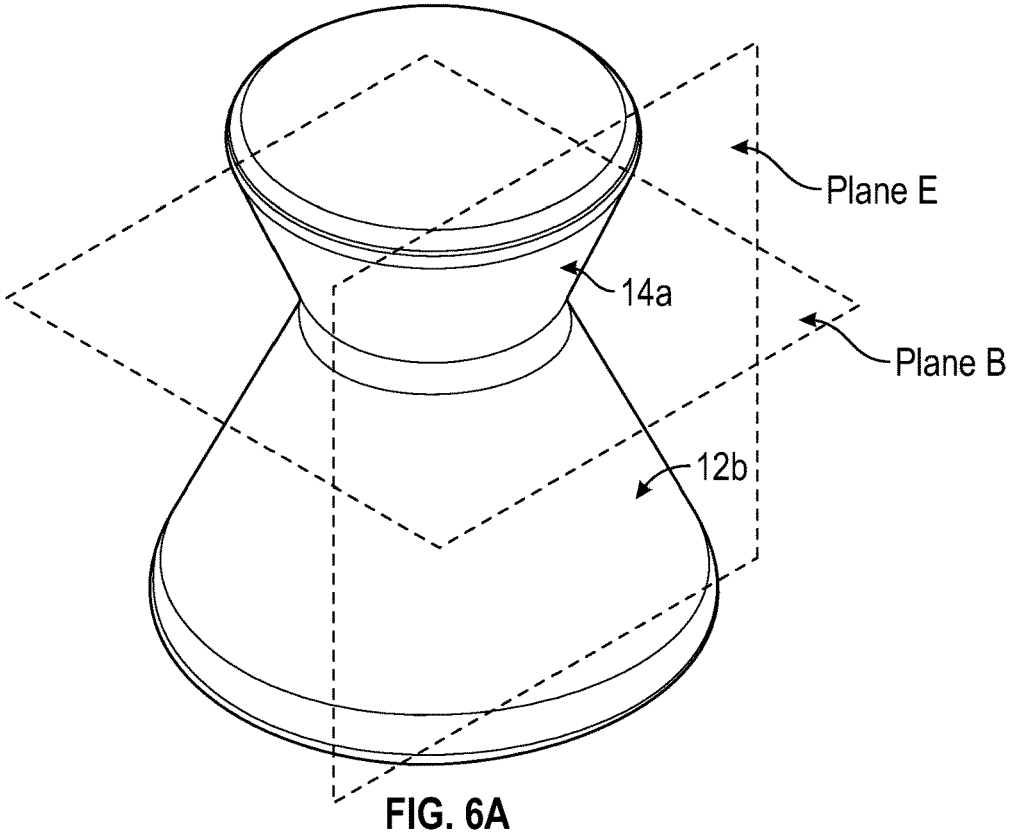
FIGS. 6A-6C are various views of the disposable personal care apparatus illustrating various aspects of the disposable personal care apparatus.
Figure 6B:
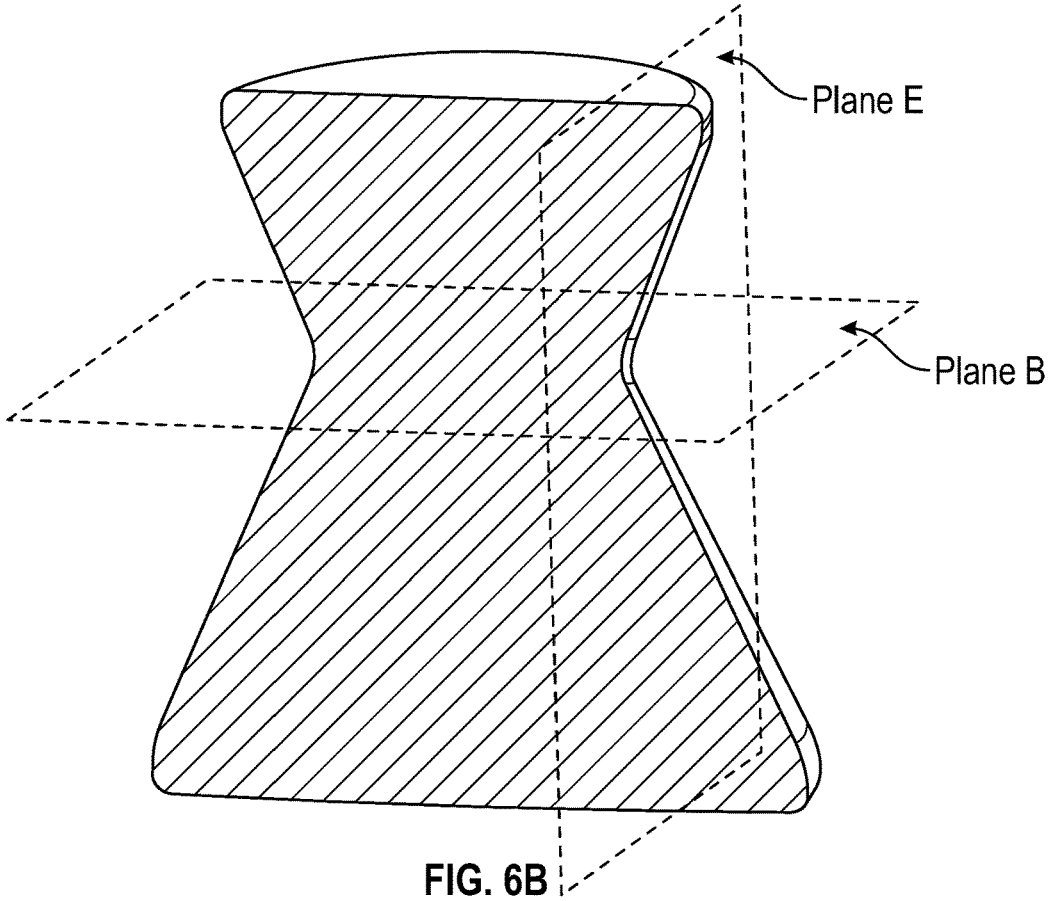
Figure 6C:
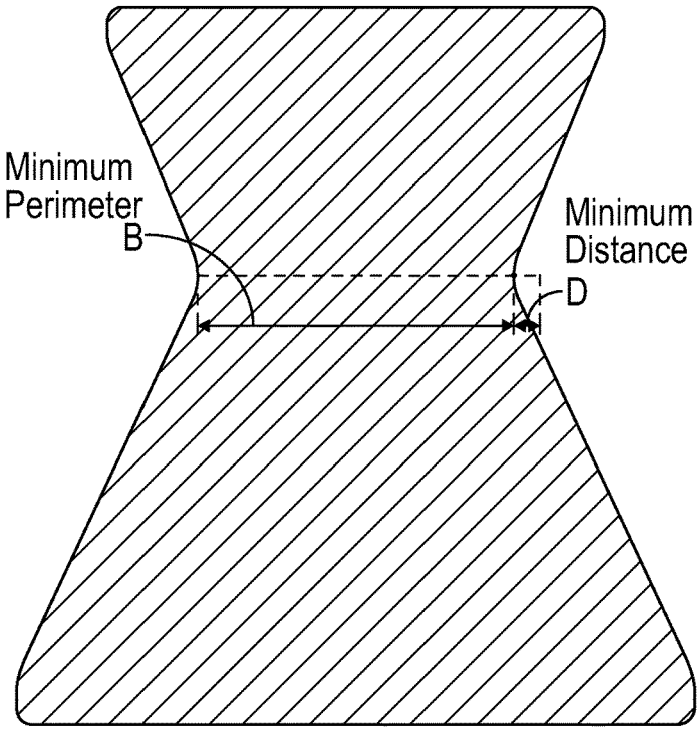
Figure 7A:
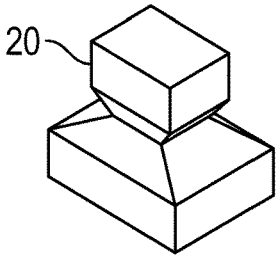
FIGS. 7A to 27E are various views of different disposable personal care apparatus in accordance with the principles of this disclosure.
Figure 8A:
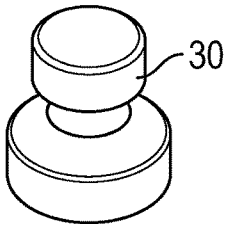
Figure 7B:
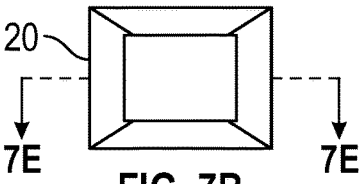
Figure 8B:
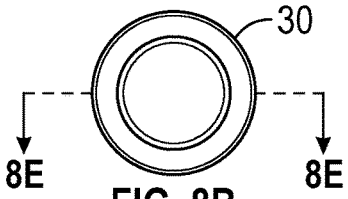
Figure 7C:
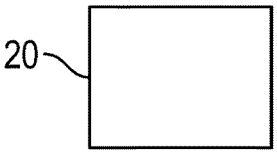
Figure 8C:
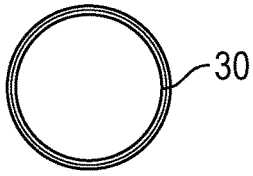
Figure 7D:
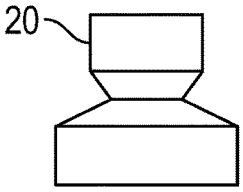
Figure 8D:
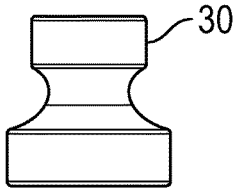
Figure 7E:
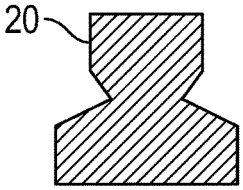
Figure 8E:
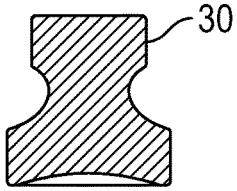
Figure 7F:
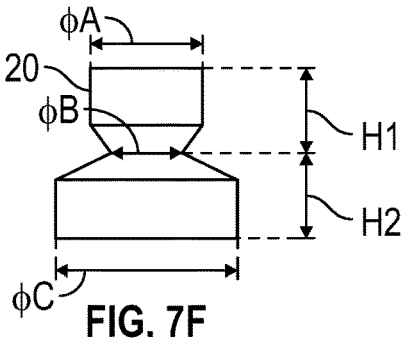
Figure 8F:
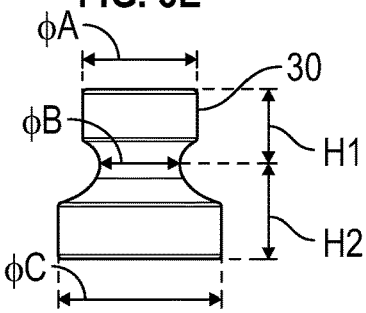
Figure 9A:
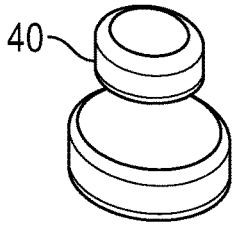
Figure 10A:
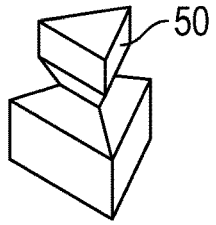
Figure 9B:
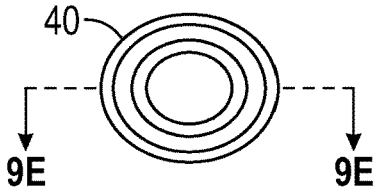
Figure 10B:
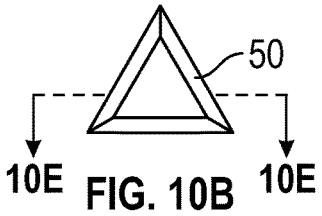
Figure 9C:
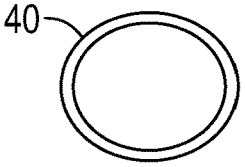
Figure 10C:
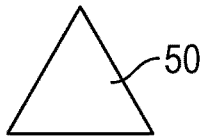
Figure 9D:
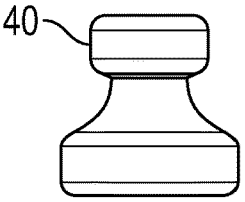
Figure 10D:
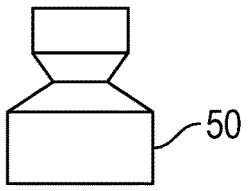
Figure 9E:
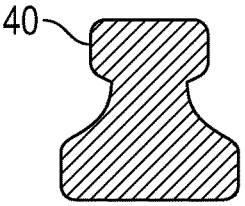
Figure 10E:
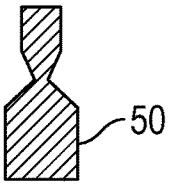
Figure 9F:
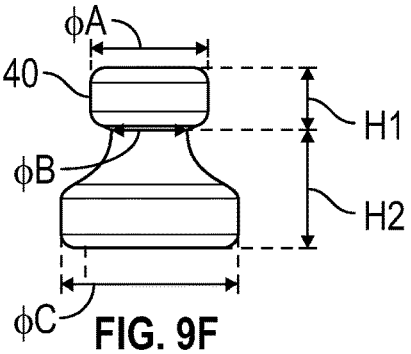
Figure 10F:
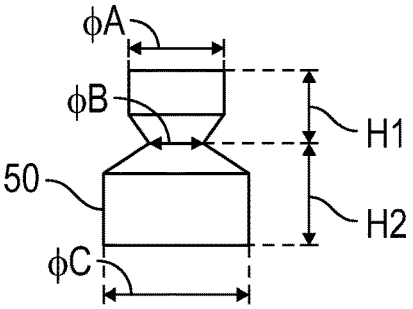
Figure 11A:
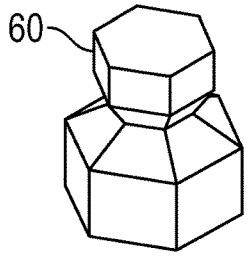
Figure 11B:
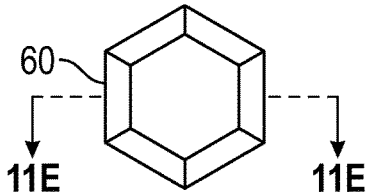
Figure 11C:
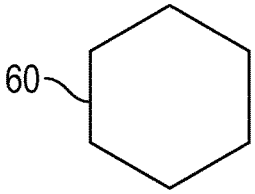
Figure 11D:
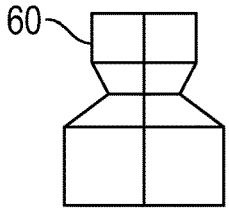
Figure 11E:
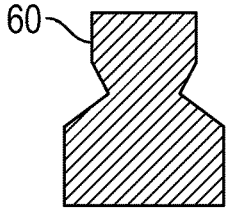
Figure 11F:
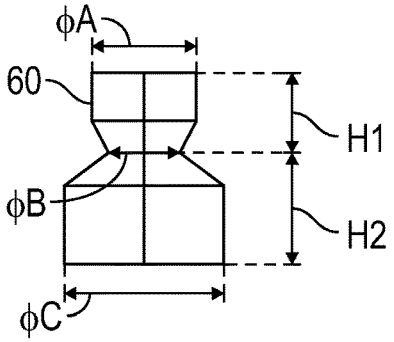
Figure 12A:
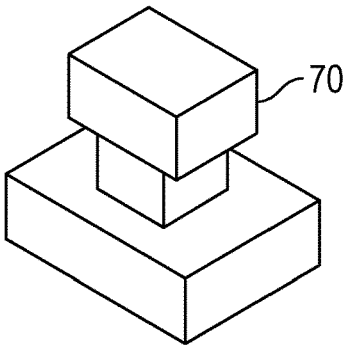
Figure 12B:
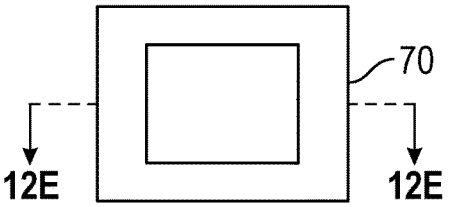
Figure 12C:
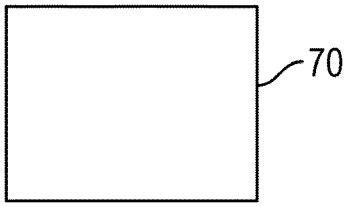
Figure 12D:
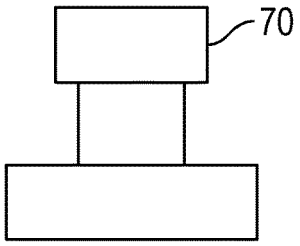
Figure 12E:
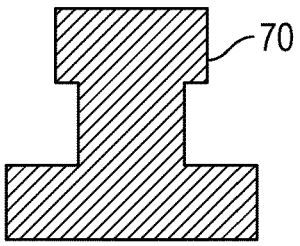
Figure 13A:
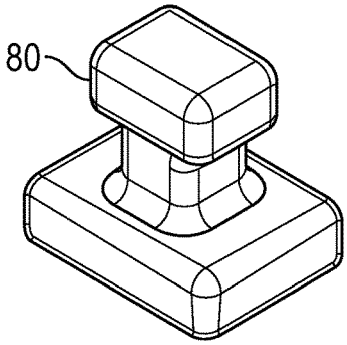
Figure 14A:
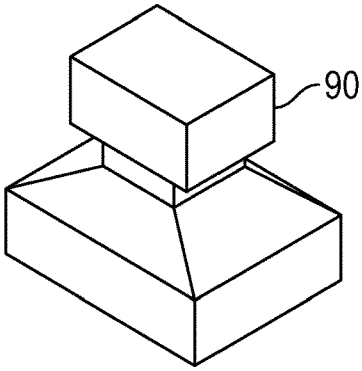
Figure 13B:
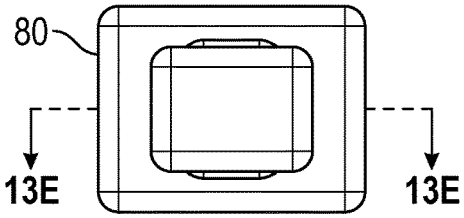
Figure 14B:
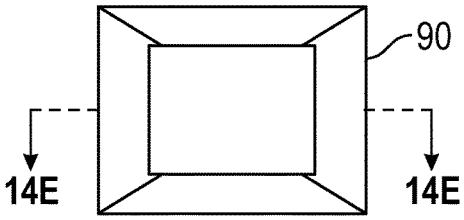
Figure 13C:
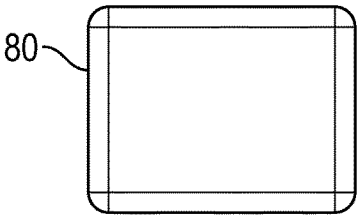
Figure 14C:
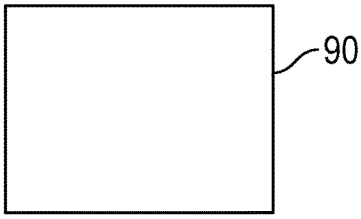
Figure 13D:
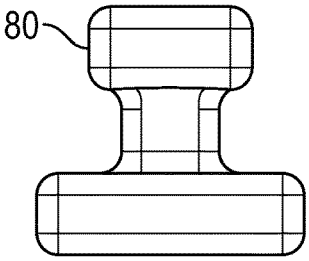
Figure 14D:
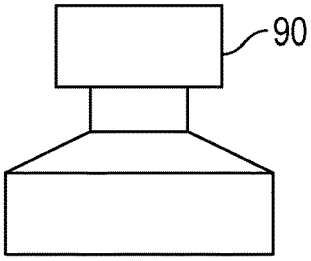
Figure 13E:
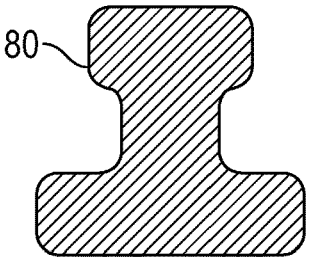
Figure 14E:
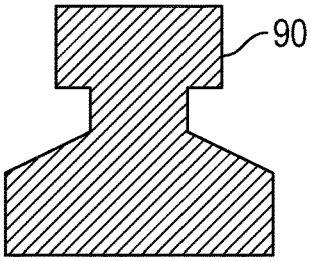
Figure 15A:
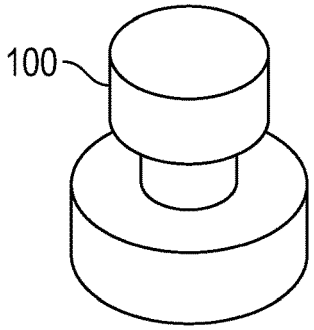
Figure 16A:
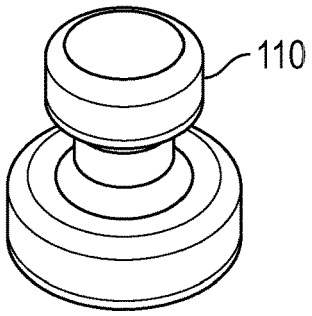
Figure 15B:
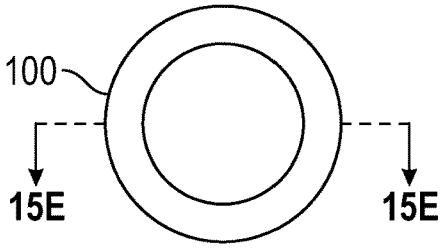
Figure 16B:
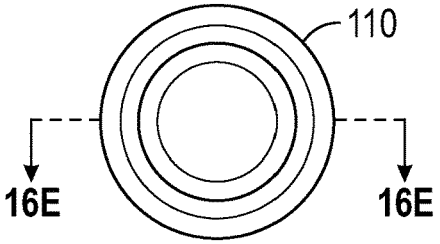
Figure 15C:
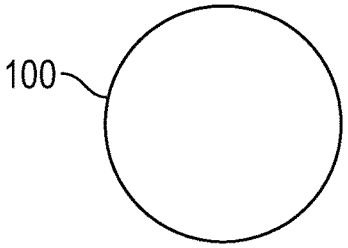
Figure 16C:
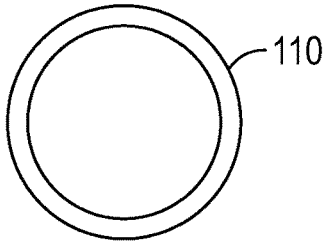
Figure 15D:
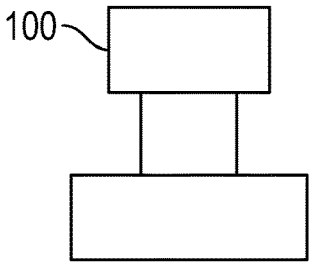
Figure 16D:
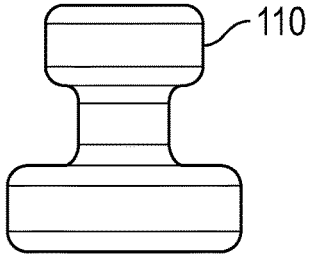
Figure 15E:
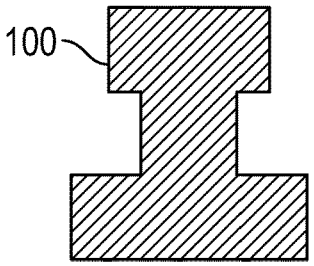
Figure 16E:
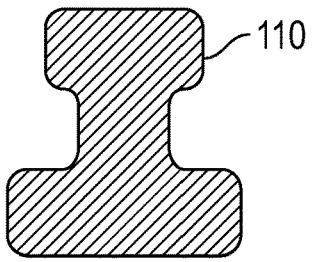
Figure 17A:
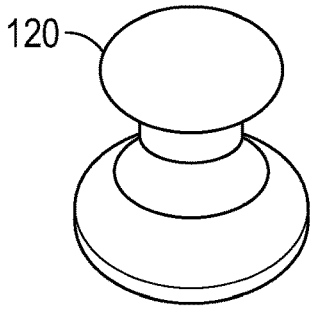
Figure 18A:
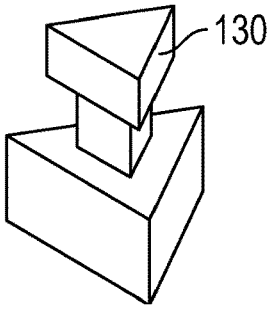
Figure 17B:
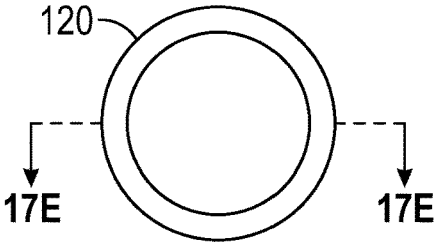
Figure 18B:
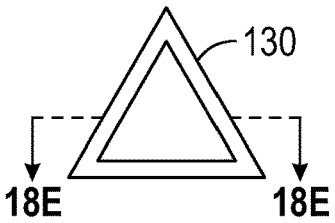
Figure 17C:
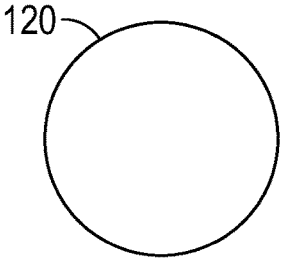
Figure 18C:
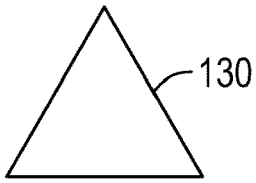
Figure 17D:
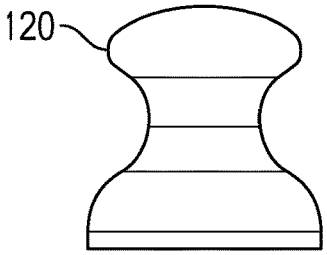
Figure 18D:
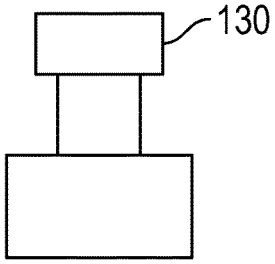
Figure 17E:
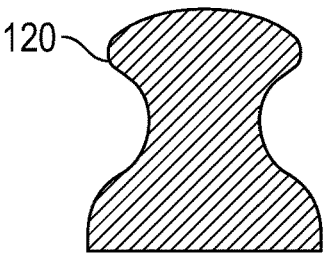
Figure 18E:
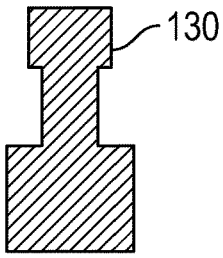
Figure 19A:
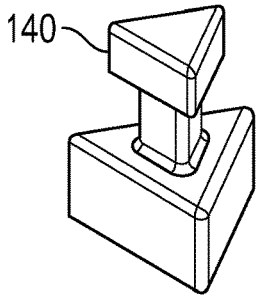
Figure 20A:
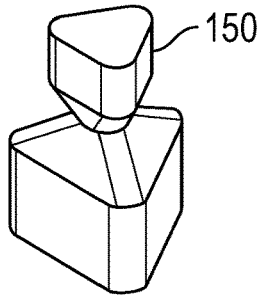
Figure 19B:
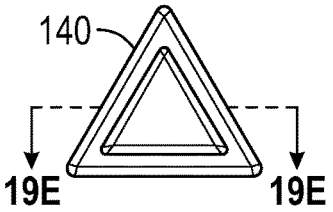
Figure 20B:
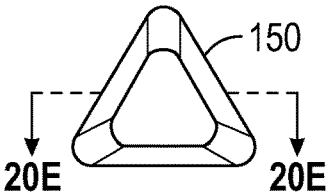
Figure 19C:
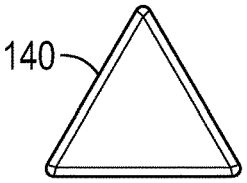
Figure 20C:
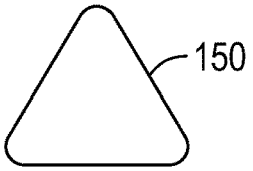
Figure 19D:
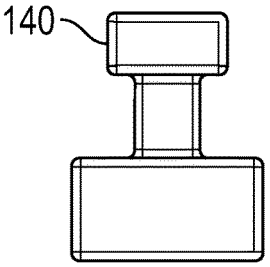
Figure 20D:
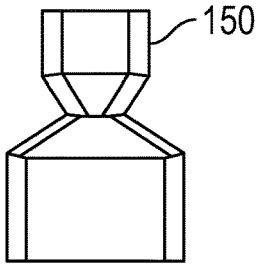
Figure 19E:
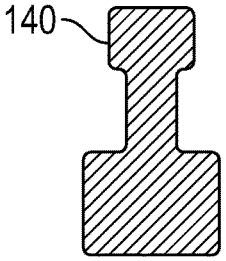
Figure 20E:
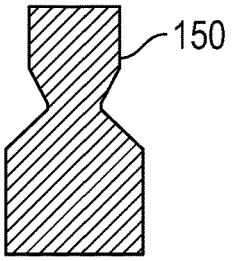
Figure 21A:
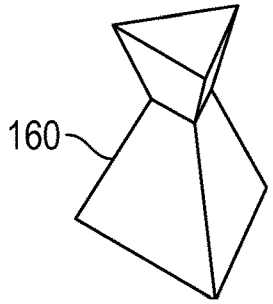
Figure 21B:
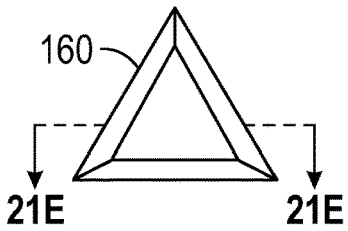
Figure 21C:
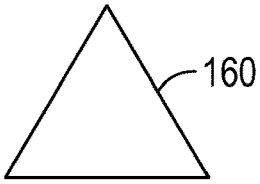
Figure 21D:
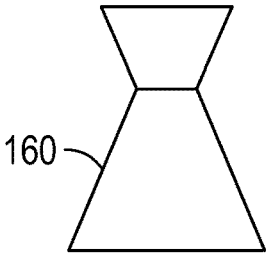
Figure 21E:
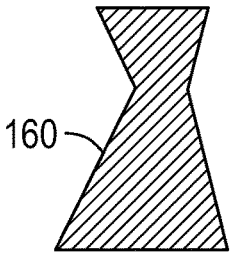
Figure 22A:
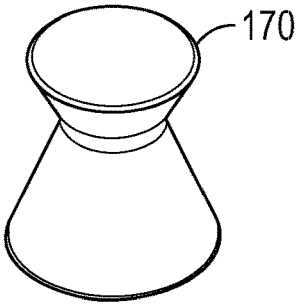
Figure 22B:
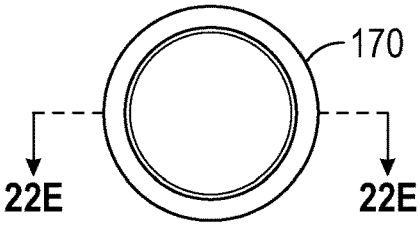
Figure 22C:
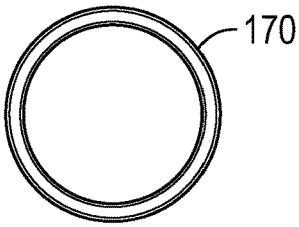
Figure 22D:
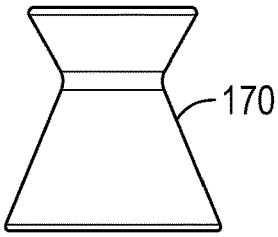
Figure 22E:
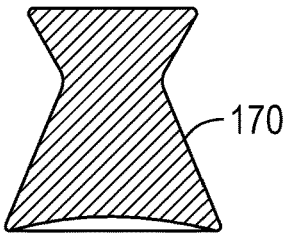
Figure 23A:
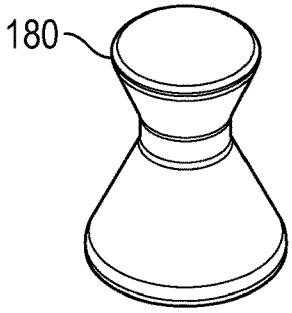
Figure 24A:
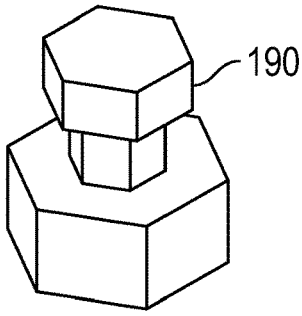
Figure 23B:
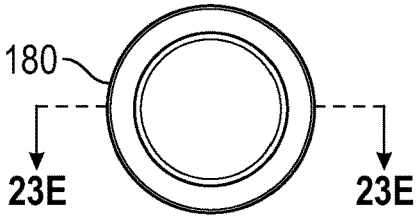
Figure 24B:
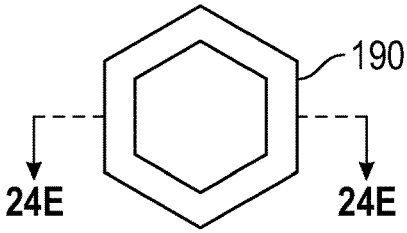
Figure 23C:
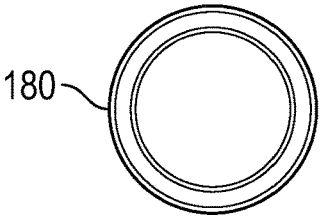
Figure 24C:
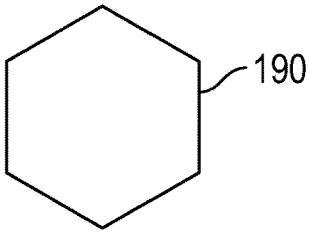
Figure 23D:
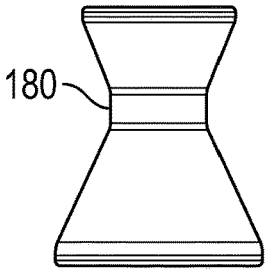
Figure 24D:
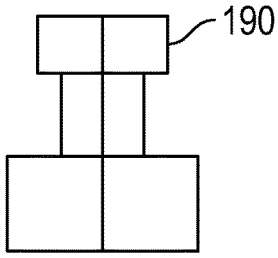
Figure 23E:
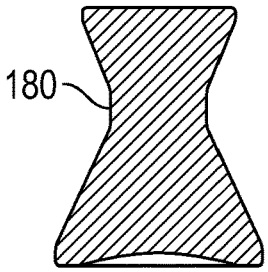
Figure 24E:
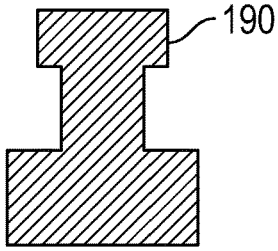
Figure 25A:
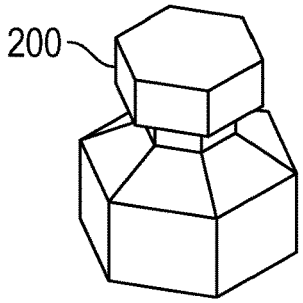
Figure 26A:
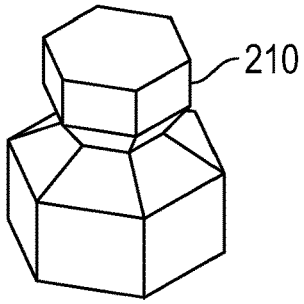
Figure 25B:
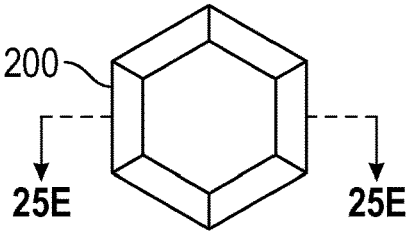
Figure 26B:
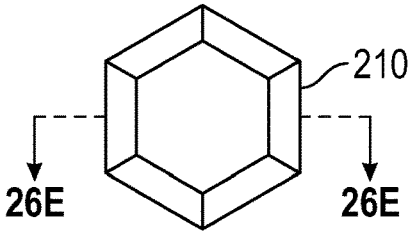
Figure 25C:
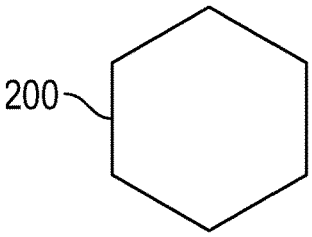
Figure 26C:
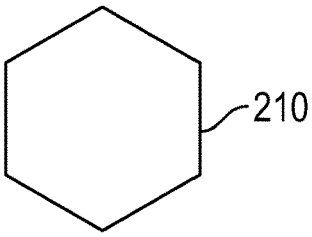
Figure 25D:
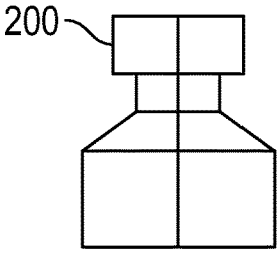
Figure 26D:
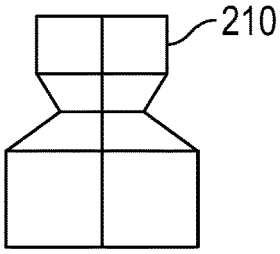
Figure 25E:
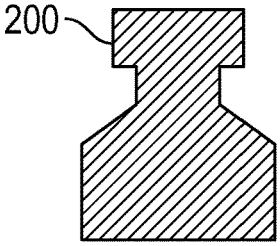
Figure 26E:
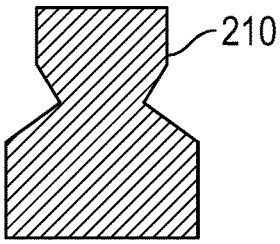
Figure 27A:
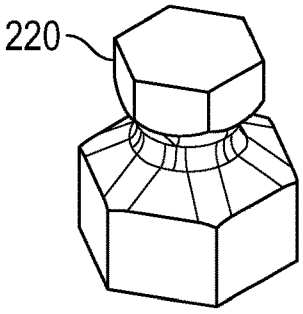
Figure 27B:
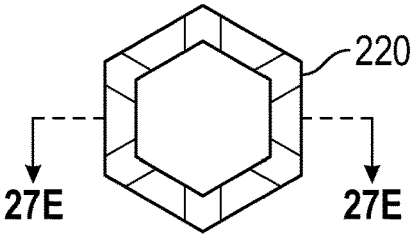
Figure 27C:
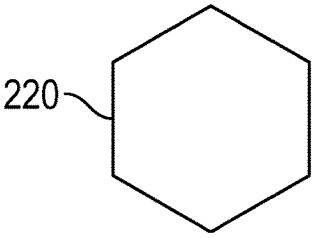
Figure 27D:
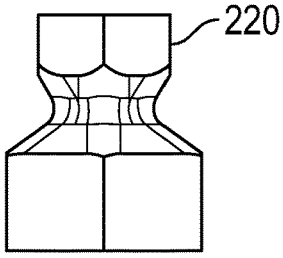
Figure 27E:
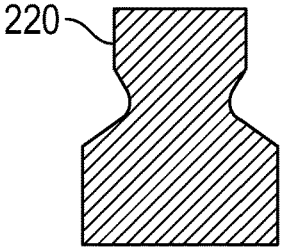

To achieve the above-noted purposes, the disclosed disposable personal care apparatus has various parameters and/or various ranges of parameters (where each disclosed range includes the endpoints and all values between the endpoints) that can be understood with reference to FIGS. 6-6C and the following definitions:

"Maximum Perimeter A" refers to a maximum perimeter (e.g., diameter and/or width) of the handle of the disposable personal care apparatus;

"Minimum Perimeter B" refers a minimum perimeter (e.g., diameter and/or width) of the stem of the disposable personal care apparatus (e.g., at a centerline of the stem that extends perpendicular to the length of the disposable personal care apparatus);

"Maximum Perimeter C" refers to a maximum perimeter (e.g., diameter and/or width) of the main body of the disposable personal care apparatus;

"First Length H1" refers to a first length of the disposable personal care apparatus that extends from the top surface of the disposable personal care apparatus (e.g., the top surface of the handle of the disposable personal care apparatus) to a narrowest region of the stem of the disposable personal care apparatus (e.g., the centerline of the stem);

"Second Length H2" refers to a second length of the disposable personal care apparatus that extends from the bottom surface of the disposable personal care apparatus (e.g., the bottom surface of the main body of the disposable personal care apparatus) to the narrowest region of the stem of the disposable personal care apparatus (e.g., the centerline of the stem);

"Plane E" refers to a vertical plane that intersects an outer surface of the annular sidewall of the handle and an outer surface of the annular sidewall of the main body, and is located such that the minimum distance from where the plane intersects the main body to where the plane intersects the handle is 12 mm (approximating the tip of the pad of an adult finger);

"Plane B" refers to a horizontal plane defined by minimum perimeter B and which is perpendicular to plane E; and "Minimum Distance D" refers to a minimum distance between perimeter B and plane E.

Such parameters and/or ranges of parameters include the following:

1. A surface area of the bottom surface of the main body of the disposable personal care apparatus is in the range of 1,425 $mm^2$ to 4,375 $mm^2$. This feature enables an adult human hand to be adequately and comfortably cleaned with the main body.
2. A surface area of the top surface of the handle of the disposable personal care apparatus is in the range of 325 $mm^2$ to 2,050 $mm^2$. This feature helps to ensure that the handle has a surface area that comfortably fits within an adult human hand.
3. A first perimeter ratio of the disposable personal care apparatus is defined by Minimum Perimeter B divided by Maximum Perimeter C and has a maximum value of 0.7 and a minimum value of 0.3. This feature helps to ensure that the handle has a surface area that comfortably fits within an adult human hand. This feature also is a contributing feature that ensures the disposable personal care apparatus can stand upright. This feature is also a contributing feature that ensures the main body degrades before the stem, preventing the main body and the handle from separating and/or snapping off.
4. A second perimeter ratio of the disposable personal care apparatus is defined by Maximum Perimeter A divided by Minimum Perimeter B and has a maximum value of 2.9 and a minimum value of 1.05. This feature helps to ensure that the handle has a surface area that comfortably fits within an adult human hand. This feature also is a contributing feature that ensures the disposable personal care apparatus can stand upright. This feature is also a contributing feature that ensures the main body degrades before the stem, preventing the main body and the handle from separating and/or snapping off.
5. A third perimeter ratio of the disposable personal care apparatus is defined by Maximum Perimeter A divided by Maximum Perimeter C and has a maximum value of 1.0 and a minimum value of 0.2. The feature ensures that the handle is the same size or smaller than the main body so that the disposable personal care apparatus can stand upright (e.g., is not top heavy and is not prone to tipping over).

6. A height ratio of the disposable personal care apparatus is defined by First Length H1 divided by Second Length H2 and has a maximum value of 2.1 and a minimum value of 0.3. This feature is one of several features that ensures that the handle does not degrade faster than the main body.
7. A volume ratio of the disposable personal care apparatus is defined by a volume of a first portion of the disposable personal care apparatus that spans across First Length H1 of the disposable personal care apparatus divided by a volume of a second portion of the disposable personal care apparatus that spans across Second Length H2 of the disposable personal care apparatus and has a maximum value of 1.0 and a minimum value of 0.2. This feature is one of several features that ensures that the handle does not degrade faster than the main body. This feature is also a contributing feature that ensures the main body degrades before the stem, preventing the main body and the handle from separating and/or snapping off.
8. A first degradation rate ratio of the disposable personal care apparatus is defined by a rate of wear of Maximum Perimeter A divided by a rate of wear of Maximum Perimeter C and has a value that is less than 1.0 and greater than 0.2. This feature ensures that the disposable personal care apparatus can stand upright when it is used while simultaneously ensuring that the main body degrades at the same rate or before the handle.
9. A second degradation rate ratio of the disposable personal care apparatus is defined by a rate of wear of Minimum Perimeter B divided by a rate of wear of a volume across First Length H1 and has a value that is less than 1.0. This feature ensures that the narrowest portion of the stem (e.g., a central portion of the stem) does not degrade faster than the handle, preventing the handle from separating from the rest of the disposable personal care apparatus due to fracture in and/or degradation of the stem.
10. A third degradation ratio of the disposable personal care apparatus is defined by a rate of wear of Minimum Perimeter B divided by a rate of wear of a volume across Second Length H2 and has a value that is less than 1.0. This feature ensures that the narrowest portion of the stem (e.g., a central portion of the stem) does not degrade faster than the main body, preventing the main body from separating from the rest of the disposable personal care apparatus due to fracture in and/or degradation of the stem.
11. A non-slip configuration of the disposable personal care apparatus is defined by the Minimum Distance D and has a value that is greater than 1.2 mm. This feature ensures that the handle is easy to grip, especially when wet, such that when the disposable personal care apparatus is held by the handle in one hand and applied to another hand, for example, the disposable personal care apparatus is less likely to slip out of the user's hand. This feature ensures that a cavity space is created on the disposal personal care apparatus that provides a nook for the tip of the user's finger pad of a sufficient size for facilitating gripping and bracing against sidewalls of the stem, handle, and main body.
12. A bending strength of the disposable personal care apparatus can be greater than or equal to 100 newtons in some aspects. The bending strength, which is defined as a maximum force the disposable personal care apparatus can endure at its narrowest section before failure, can range, in some aspects, from 188 to 312 newton, for example. This failure is characterized by the initiation and propagation of a crack throughout the entire cross section of the soap, culminating in its bifurcation. When a sample undergoes bending, two primary parameters dictate its behavior: the material properties (i.e., Young's modulus, yield strength, etc.) and the sample's geometry, particularly its moment of inertia, which strongly influences the article's resistance to bending. The bending strength inherently encompasses the effects of the moment of inertia of the disposable personal care apparatus, a geometry-dependent parameter. The relationship between bending strength (applied force F), bending stress ($\sigma$), and the moment of inertia can be broadly represented as $\sigma \propto F/I$. This quantitative measure of the resistance of the disposable personal care apparatus to bending stress highlights its structural robustness under external loading conditions while also underscoring the influential role played by the unique geometry of the disposable personal care apparatus.

In aspects, the disposable personal care apparatus of this disclosure, or portions thereof, can be blended and/or fused to form a curved solid or curvilinear geometry. In aspects, the disposable personal care apparatus of this disclosure, or portions thereof, can include one or more surface textures, coatings, and/or layers such as depressions, indicia, voids, protuberances, and/or the like, which may have any suitable configuration. Indeed, the disposable personal care apparatus of this disclosure can have any suitable geometrical configuration including any number, shape, and/or arrangement of surfaces and/or edges (e.g., planar, curved, concave, convex, linear, chamfered, textured, marked, beveled, rounded, cornered, etc., or combinations thereof), as illustrated in FIGS. 7A to 27E.

In aspects, the disposable personal care apparatus of this disclosure, or portions thereof, can include non-soap material that can aid in cleaning (e.g., exfoliating beads) and/or which can provide aesthetic value (e.g., dried botanical flowers).

In aspects, the disposable personal care apparatus of this disclosure, or portions thereof, can include one or more different soaps. For instance, the handle 14 can be made of a first material and the main body 12 can be made from a second material that is different than the first material. The first and/or second materials may be soap and/or non-soap materials. The first and/or second materials may include the same and/or different ingredients and/or the same and/or different ratios of one or more ingredients. The first and/or second materials may have the same and/or different (i) physical properties (e.g., tensile strength, density, melting point, softening point, hardness, malleability, viscosity, magnetism), (ii) chemical properties (e.g., pH, solubility, chemical reactivity, chemical stability), and/or (iii) aesthetic characteristics (e.g., color, opacity, reflectivity, etc.).

In aspects, the disposable personal care apparatus of this disclosure, or portions thereof, may include deodorant/antiperspirant (e.g., aluminium chlorohydrate and aluminium-zirconium tetrachlorohydrate gly), sunscreen/sunblock (e.g., avobenzone, octinoxate, oxybenzone, titanium dioxide, zinc oxide, and/or the like), shaving cream/foam/lotion (e.g., stearic acid, triethanolamine, glycerin, polyoxyethylene sorbitan monostearate, water, and/or the like)), shampoo, conditioner, moisturizer, chemical exfoliant (e.g., salicylic acid, lipo hydroxy acid (LHA), glycolic acid, and/or the like), and/or medicinal materials (e.g., anti-fungals, anti-bacterials, and/or the like), and/or mixtures thereof.

In aspects, the disposable personal care apparatus of this disclosure, or portions thereof, may include one or more lathering compositions including, for example, anionic surfactants including sarcosinates, sulfates, salfonates, isethionates, phosphates, taurates, lactylates, glutarnates, soaps and mixtures thereof; nonionic surfactants including amine oxides, alkyl glucosides, alkyl polyglucosides, polyhydroxy fatty acid amides, alkoxylated fatty acid esters, sucrose esters, and mixtures thereof; and/or amphoteric surfactants including betaines, sultaines, hydroxysultaines, alkyliminoacetates, iminodialkanoates, aminoalkanoates, and/or mixtures thereof.

In aspects, the disposable personal care apparatus of this disclosure, or portions thereof, may include one or more benefit agents including, for example, vitamins, zeolites, peptides, sunscreen actives, terpene alcohols, desquamation actives, anti-acne actives, anti-wrinkle actives, anti-atrophy actives, anti-oxidants, flavanoids, anti-inflammatory agents, anti-cellulite agents, topical anesthetics, tanning actives, chelators, skin lightening agents, antimicrobial actives, anti-fungal actives, skin soothing actives, skin healing actives, skin moisturizing actives, cosmetic actives, and/or mixtures thereof.

In aspects, the disposable personal care apparatus of this disclosure, or portions thereof, may include one or more conditioning agents including, for example, petrolatum, fatty acids, esters of fatty acids, fatty alcohols, ethoxylated alcohols, polyol polyesters, glycerine, glycerin mono-esters, glycerin polyesters, epidermal and sebaceous hydrocarbons, lanolin, straight and branched hydrocarbons, silicone oil, silicone gum, vegetable oil, vegetable oil adduct, hydrogenated vegetable oils, nonionic polymers, natural waxes, synthetic waxes, polyolefinic glycols, polyolefinic monoester, polyolefinic polyesters, cholesterols, cholesterol esters, and/or mixtures thereof.

The subject matter of this disclosure may be further described by reference to the following numbered aspects:

1. A disposable personal care apparatus, comprising:
   - a main body having a first body end and a second body end, the main body including soap;
   - a handle configured to be grasped for moving the main body, the handle integrally formed with the main body, the handle having a first handle end and a second handle end, the second handle end of the handle closer to the first body end of the main body than the second body end of the main body, the main body configured to support the handle in an upright position over the main body when the second body end of the main body is positioned on a surface; and
   - a longitudinal axis extending a length of the disposable personal care apparatus from the first handle end to the second body end.
2. The disposable personal care apparatus according to aspect 1, wherein the handle is configured to degrade at the same rate or slower than the main body.
3. The disposable personal care apparatus according to aspect 2, wherein the handle is the same size or smaller than the main body.
4. The disposable personal care apparatus according to aspect 3, wherein the handle is connected to the main body by a stem.
5. The disposable personal care apparatus according to aspect 4, wherein the stem is configured to degrade at the same rate or slower than the handle.
6. The disposable personal care apparatus according to aspect 1, wherein the handle is formed of a first material and the main body is formed of a second material, the first and second materials being different.
7. The disposable personal care apparatus according to aspect 1, further comprising a bottom surface on the second body end of the main body, the bottom surface having a surface area that ranges from 1,425 $mm^2$ to 4,375 $mm^2$.
8. The disposable personal care apparatus according to aspect 7, further comprising a top surface on the first handle end of the handle, the top surface having a surface area that ranges from 325 $mm^2$ to 2,050 $mm^2$.
9. The disposable personal care apparatus according to aspect 4, wherein the main body has a maximum width C and the stem has a minimum width B, wherein a first perimeter ratio of the disposable personal care apparatus is defined by the minimum width B divided by the maximum width C, and wherein the first perimeter ratio ranges from 0.3 to 0.7.
10. The disposable personal care apparatus according to aspect 9, wherein the handle has a maximum width A, wherein a second perimeter ratio of the disposable personal care apparatus is defined by the maximum width A divided by the minimum width B, and wherein the second perimeter ratio ranges from 1.05 to 2.9.
11. The disposable personal care apparatus according to aspect 10, further comprising a third perimeter ratio defined by the maximum width A divided by the maximum width C such that the third perimeter ratio ranges from 0.2 to 1.0.
12. The disposable personal care apparatus according to aspect 8, further comprising a height ratio defined by a first length H1 divided by a second length H2, the first length H1 extending from the top surface to a line disposed between the handle and the main body that is transverse to the longitudinal axis, wherein the height ratio ranges from 0.3 to 2.1.
13. The disposable personal care apparatus according to aspect 12, further comprising a volume ratio defined by a first volume of a first portion of the disposable personal care apparatus that spans across the first length H1 divided by a second volume across a second portion of the disposable personal care apparatus that spans across the second length H2, wherein the range of the volume ratio is from 0.2 to 1.0.
14. The disposable personal care apparatus according to aspect 10, further comprising a degradation rate ratio that is less than 1.0, wherein the degradation rate is defined by at least one of:
    - a rate of wear of the maximum width A divided by a rate of wear of the maximum width C;
    - a rate of wear of the minimum width B divided by a rate of wear of a volume across a first length H1 of the disposable personal care apparatus, wherein the first length H1 extends from a top surface of the handle to a line disposed between the handle and the main body that is transverse to the longitudinal axis; or
    - the rate of wear of the minimum width B divided by a rate of wear of a volume across a second length H2 of the disposable personal care apparatus, wherein the second length H2 extends from a bottom surface of the main body to the line.
15. The disposable personal care apparatus according to aspect 14, wherein the degradation rate ratio is greater than 0.2.

16. A cleansing apparatus, comprising:
   a main body including a surfactant configured for cleaning, the main body defining a bottom surface of the cleansing apparatus;
   a handle integrally formed with the main body, the main body configured to support the handle in an upright position over the main body when the main body is mounted on a surface such that the cleansing apparatus has a non-slip configuration, the handle defining the top surface of the cleansing body;
   a longitudinal axis that extends from the top surface to the bottom surface;
   a height ratio defined by a first length H1 divided by a second length H2, the first length extending from the top surface to a line disposed between the handle and the main body that is transverse to the longitudinal axis, wherein the height ratio ranges from 0.3 to 2.1; and
   a volume ratio defined by a first volume of a first portion of the cleansing apparatus that spans across the first length H1 divided by a second volume across a second portion of the cleansing apparatus that spans across the second length H2, wherein the range of the volume ratio is from 0.2 to 1.0.
17. The cleansing apparatus of aspect 16, wherein the cleansing apparatus has an hour-glass profile and the handle is the same size or smaller than the main body.
18. The cleansing apparatus of aspect 17, further comprising a stem that connects the main body to the handle.
19. The cleansing apparatus of aspect 18, wherein the main body has a first width C and the stem has a second width B, wherein a first perimeter ratio of the cleansing apparatus is defined by the second width B divided by the first width C, and wherein the first perimeter ratio ranges from 0.3 to 0.7.
20. The cleansing apparatus of aspect 18, further comprising a degradation rate ratio that is less than 1 and wherein the degradation rate is defined by at least one of:
   a rate of wear of a maximum width A of the handle divided by a rate of wear of a maximum width C of the main body;
   a rate of wear of the minimum width B of the stem divided by a rate of wear of a volume across a first length H1 of the disposable personal care apparatus, wherein the first length H1 extends from a top surface of the handle to a line disposed between the handle and the main body that is transverse to the longitudinal axis; or
   the rate of wear of the minimum width B divided by a rate of wear of a volume across a second length H2 of the disposable personal care apparatus, wherein the second length H2 extends from a bottom surface of the main body to the line.

The phrases "in an aspect," "in aspects," "in various aspects," "in some aspects," "in other aspects" or the like may each refer to one or more of the same or different aspects in accordance with the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

Various aspects disclosed herein may be combined in different combinations than the combinations specifically presented in the description and accompanying drawings. It should also be understood that, depending on the example, certain acts or events of any of the processes or methods described herein may be performed in a different sequence, may be added, merged, or left out altogether (e.g., all described acts or events may not be necessary to carry out the techniques).

Certain aspects of the present disclosure may include some, all, or none of the above advantages and/or one or more other advantages readily apparent to those skilled in the art from the drawings, descriptions, and claims included herein. Moreover, while specific advantages have been enumerated above, the various aspects of the present disclosure may include all, some, or none of the enumerated advantages and/or other advantages not specifically enumerated above.

The aspects disclosed herein are examples of the disclosure and may be embodied in various forms. For instance, although certain aspects herein are described as separate, each of the aspects herein may be combined with one or more of the other aspects herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

Persons skilled in the art will understand that the structures and methods specifically described herein and shown in the accompanying figures are non-limiting exemplary aspects, and that the description, disclosure, and figures should be construed merely as exemplary of aspects. It is to be understood, therefore, that this disclosure is not limited to the precise aspects described, and that various other changes and modifications may be effectuated by one skilled in the art without departing from the scope or spirit of the disclosure. Additionally, the elements and features shown or described in connection with certain aspects may be combined with the elements and features of certain other aspects without departing from the scope of this disclosure, and that such modifications and variations are also included within the scope of this disclosure. Accordingly, the subject matter of this disclosure is not limited by what has been particularly shown and described.

What is claimed is:

1. A disposable personal care apparatus, comprising:
   a main body having a first body end and a second body end, the main body including soap;
   a handle configured to be grasped for moving the main body, the handle integrally formed with the main body, the handle having a first handle end and a second handle end, the second handle end of the handle closer to the first body end of the main body than the second body end of the main body, the main body configured to support the handle in an upright position over the main body when the second body end of the main body is positioned on a surface, the handle being configured to degrade at the same rate or slower than the main body; and
   a longitudinal axis extending a length of the disposable personal care apparatus from the first handle end to the second body end.

2. The disposable personal care apparatus according to claim 1, wherein the handle is the same size or smaller than the main body.

3. The disposable personal care apparatus according to claim 2, wherein the handle is connected to the main body by a stem.

4. The disposable personal care apparatus according to claim 3, wherein the stem is configured to degrade at the same rate or slower than the handle.

5. The disposable personal care apparatus according to claim 1, wherein the handle is formed of a first material and the main body is formed of a second material, the first and second materials being different.

6. The disposable personal care apparatus according to claim 3, wherein the main body has a maximum width C and the stem has a minimum width B, wherein a first perimeter ratio of the disposable personal care apparatus is defined by the minimum width B divided by the maximum width C, and wherein the first perimeter ratio ranges from 0.3 to 0.7.

7. The disposable personal care apparatus according to claim 6, wherein the handle has a maximum width A, wherein a second perimeter ratio of the disposable personal care apparatus is defined by the maximum width A divided by the minimum width B, and wherein the second perimeter ratio ranges from 1.05 to 2.9.

8. The disposable personal care apparatus according to claim 7, further comprising a third perimeter ratio defined by the maximum width A divided by the maximum width C such that the third perimeter ratio ranges from 0.2 to 1.0.

9. The disposable personal care apparatus according to claim 7, further comprising a degradation rate ratio that is less than 1.0, wherein the degradation rate is defined by at least one of:

a rate of wear of the maximum width A divided by a rate of wear of the maximum width C;

a rate of wear of the minimum width B divided by a rate of wear of a volume across a first length H1 of the disposable personal care apparatus, wherein the first length H1 extends from a top surface of the handle to a line disposed between the handle and the main body that is transverse to the longitudinal axis; or the rate of wear of the minimum width B divided by a rate of wear of a volume across a second length H2 of the disposable personal care apparatus, wherein the second length H2 extends from a bottom surface of the main body to the line.

10. The disposable personal care apparatus according to claim 9, wherein the degradation rate ratio is greater than 0.2.

11. A disposable personal care apparatus, comprising:

a main body having a first body end and a second body end, the main body including soap;

a bottom surface on the second body end of the main body, the bottom surface having a surface area that ranges from 1,425 $mm^2$ to 4,375 $mm^2$;

a handle configured to be grasped for moving the main body, the handle integrally formed with the main body, the handle having a first handle end and a second handle end, the second handle end of the handle closer to the first body end of the main body than the second body end of the main body, the main body configured to support the handle in an upright position over the main body when the second body end of the main body is positioned on a surface; and a longitudinal axis extending a length of the disposable personal care apparatus from the first handle end to the second body end.

12. The disposable personal care apparatus according to claim 11, further comprising a top surface on the first handle end of the handle, the top surface having a surface area that ranges from 325 $mm^2$ to 2,050 $mm^2$.

13. The disposable personal care apparatus according to claim 12, further comprising a height ratio defined by a first length H1 divided by a second length H2, the first length H1 extending from the top surface to a line disposed between the handle and the main body that is transverse to the longitudinal axis, wherein the height ratio ranges from 0.3 to 2.1.

14. The disposable personal care apparatus according to claim 13, further comprising a volume ratio defined by a first volume of a first portion of the disposable personal care apparatus that spans across the first length H1 divided by a second volume across a second portion of the disposable personal care apparatus that spans across the second length H2, wherein the range of the volume ratio is from 0.2 to 1.0.

15. A cleansing apparatus, comprising:

a main body including a surfactant configured for cleaning, the main body defining a bottom surface of the cleansing apparatus;

a handle integrally formed with the main body, the main body configured to support the handle in an upright position over the main body when the main body is mounted on a surface such that the cleansing apparatus has a non-slip configuration, the handle defining the top surface of the cleansing body;

a longitudinal axis that extends from the top surface to the bottom surface;

a height ratio defined by a first length H1 divided by a second length H2, the first length extending from the top surface to a line disposed between the handle and the main body that is transverse to the longitudinal axis, wherein the height ratio ranges from 0.3 to 2.1; and a volume ratio defined by a first volume of a first portion of the cleansing apparatus that spans across the first length H1 divided by a second volume across a second portion of the cleansing apparatus that spans across the second length H2, wherein the range of the volume ratio is from 0.2 to 1.0.

16. The cleansing apparatus of claim 15, wherein the cleansing apparatus has an hour-glass profile and the handle is the same size or smaller than the main body.

17. The cleansing apparatus of claim 16, further comprising a stem that connects the main body to the handle.

18. The cleansing apparatus of claim 17, wherein the main body has a first width C and the stem has a second width B, wherein a first perimeter ratio of the cleansing apparatus is defined by the second width B divided by the first width C, and wherein the first perimeter ratio ranges from 0.3 to 0.7.

19. The cleansing apparatus of claim 17, further comprising a degradation rate ratio that is less than 1 and wherein the degradation rate is defined by at least one of:

a rate of wear of a maximum width A of the handle divided by a rate of wear of a maximum width C of the main body;

a rate of wear of the minimum width B of the stem divided by a rate of wear of a volume across a first length H1 of the disposable personal care apparatus, wherein the first length H1 extends from a top surface of the handle to a line disposed between the handle and the main body that is transverse to the longitudinal axis; or the rate of wear of the minimum width B divided by a rate of wear of a volume across a second length H2 of the disposable personal care apparatus, wherein the second length H2 extends from a bottom surface of the main body to the line.

* * * * *